United States Patent [19]

Frohlich

[11] 4,127,147

[45] Nov. 28, 1978

[54] PROCESS FOR MANUFACTURING A WOVEN SLIDE-FASTENER UNIT

[75] Inventor: Alfons Frohlich, Essen, Germany

[73] Assignee: OPTI Patent- Forschungs- und Fabrikations-AG, Glarus, Switzerland

[21] Appl. No.: 755,592

[22] Filed: Dec. 30, 1976

Related U.S. Application Data

[62] Division of Ser. No. 722,339, Sep. 10, 1976, Pat. No. 4,078,585.

[30] Foreign Application Priority Data

Sep. 10, 1975 [DE] Fed. Rep. of Germany ..... 2540238
Sep. 10, 1975 [DE] Fed. Rep. of Germany ..... 2540272
Jun. 1, 1976 [DE] Fed. Rep. of Germany ..... 2624450

[51] Int. Cl.[2] ..... D03D 47/06

[52] U.S. Cl. ..... 139/11; 139/116; 139/442

[58] Field of Search ..... 139/11, 22, 23, 35, 139/116, 384 B, 442; 24/205.16 C

[56] References Cited

U.S. PATENT DOCUMENTS

| | | | |
|---|---|---|---|
| 3,249,126 | 5/1966 | Gerlach | 139/22 |
| 3,258,034 | 6/1966 | Gerlach | 139/11 |
| 3,765,457 | 10/1973 | Glindmeyer et al. | 139/384 B |
| 3,847,188 | 11/1974 | Auer et al. | 24/205.16 C |
| 3,945,407 | 3/1976 | Jakob | 139/384 B |
| 4,027,703 | 6/1977 | Diesner | 139/22 |

*Primary Examiner*—Henry S. Jaudon
*Attorney, Agent, or Firm*—Karl F. Ross

[57] ABSTRACT

A slide fastener comprises two continuous plastic filaments, each with a multiplicity of helicoidal coupling elements for interlocking with the elements of the opposite filament, each filament being woven integral with the threads of its respective support tape to form a single tape-like unit. Each coupling element has a coupling head on a loop end and a long shank and a short shank extending from opposite sides of the loop end. The long shank terminates in a first bight portion connecting it with a long shank of one adjacent coupling element, while the short shank terminates in a second bight portion connecting it with a short shank of another adjacent coupling element. The coupling elements are arranged in rows of mirror-image pairs, each including two long shanks and two short shanks. Warp threads are interwoven with the coupling elements, with even stronger bracing possible with bulbous projections on the long shanks, short shanks, first bight portions or second bight portions using textile weft threads.

6 Claims, 17 Drawing Figures

108
110
111'
115
115'

B
111'

108
110
116
116
111'

PROCESS FOR MANUFACTURING A WOVEN SLIDE-FASTENER UNIT

CROSS-REFERENCE TO RELATED APPLICATIONS

This application is a division of my copending application Ser. No. 722,339, filed Sept. 10, 1976 (U.S. Pat. No. 4,078,585 issued March 14, 1978) and is related to my commonly assigned copending applications Ser. No. 722,047 (U.S. Pat. No. 4,084,297 issued Apr. 18, 1978), Ser. Nos. 722,048 and 722,265 all filed Sept. 10, 1976.

FIELD OF THE INVENTION

My present invention relates to a woven slide-fastener unit. More particularly the invention relates to a system wherein the coupling elements along each row alternate in length.

BACKGROUND OF THE INVENTION

Known slide fasteners comprise coupling elements formed from a pair of plastic filaments in a helix or meander attached to a pair of confronting support tapes, usually by chain stitches or warp threads. A slider interlocks the coupling elements on the confronting edges. Since the tape is made independently of the coupling elements, allowance must be left for sewing on of the filaments. At present, either the tape is made of continuous pattern of weft and warp threads, or gaps are left in the pattern to be filled in when the element-attaching threads are added.

The resulting fastener has coupling elements with spaced-apart shank portions, leaving room for the attaching threads or the weft. This arrangement lacks stability, since the properties of the fabric and threads affect the alignment of the coupling elements. Stretching or shrinking can occur due to moisture absorption, applied stress, washing or dry cleaning. The bights which connect the coupling elements cannot stabilize these forces, especially since spiral elements have large portions which are free of attaching threads. All these problems are most significant in the very thin plastic filaments commonly employed in the dress industry. Usually the coupling elements are of uniform equal length.

Present slide-fastener manufacturing processes and apparatus can apply relatively few coupling elements to a given number of warp threads. Automatic warp needles avoid this limitation, but are able to produce slide fastener halves, necessitating a multistage process.

More especially, the common helical-coil slide fastener comprises a helix of thermoplastic synthetic-resin monofilament which can form along one side of the helix a multiplicity of coupling elements or heads which are slightly deformed parallel to the axis of the helix so as to interfit or interdigitate with the coupling head of another such coil on the confronting slide-fastener half. The coupling head of each turn of the helix is connected by a pair of relatively short shanks to bight portions or bends opposite the coupling head to the shanks of successive turns of the helix. The helix can be somewhat flattened so as to have an elliptical profile as seen along the axis of the helix and the space between each bight and its coupling head is the minimum required to effect coiling of the monofilament.

When such a helix is applied to a woven textile tape, it can receive a filler cord and chain stitching can pass over the shanks and between successive shanks which are spaced apart in accordance with the pitch of the helix to secure the helix to the support tape.

As noted previously it is also possible to "weave" to helix into the support tape directly in which case a loop of at least one and possibly more weft threads passes between each turn of the helix which lies in the manner of a warp within the tape, the coupling heads projecting along an edge of the latter.

There is, therefore, a minimal spacing between each coupling head and the respective bight and a transverse spacing between the successive shanks, even of a single coupling head, which is equal substantially to the pitch of the helix and hence the center-to-center spacing of the coupling heads. Of course, the pitch at any given time is dependent upon the physical parameters of the threads which pass between the shanks, whether these threads are the chainstitching threads or the weft threads which hold the helix in place. The pitch is not, for the most part, completely stable since the spacing between the coupling elements is determined by the textile material interposed between them as noted immediately above. With shrinkage e.g. resulting from the action of moisture, or stretching (e.g. resulting from the application of stress), by the effect of heat and like environmental phenomena, the textile material between the coupling elements varies in dimension and the interelement spacing can vary along the coil or can vary between the two coils. This can interfere with opening and closing of the slide fastener and furthermore limits the closeness with which the coupling elements can be spaced because the minimum spacing is determined by the textile material interposed between these elements.

OBJECTS OF THE INVENTION

It is therefore an object of my present invention to provide an improved slide fastener of the above-described general type.

Another object is to provide a slide fastener of more stable construction which is easy to produce.

Yet a further object of the invention is to provide an improved method of making my new slide fastener.

It is also an object of the invention to provide an improved apparatus for making slide-fastener halves or stringers.

SUMMARY OF THE INVENTION

The present invention provides a slide fastener in which the spacing of the coupling elements from one another is no longer dependent upon the type of anchoring system which is used for securing the coil to the supporting structure or tape because of the use of a novel technique whereby the coil is elongated transverse to its longitudinal axis so that the space between one bight and the respective coupling head is a multiple of the spacing previously encountered and indeed can be sufficient to allow at least one of the shanks to act at least in part as the exclusive weft over at least a portion of the support structure for the coupling heads.

The coupling heads can be elongated eye-like loops or eyes lying in planes perpendicular to the plane of the slide fastener and having shanks extending away from the eye and merging therewith at transition regions whose projections on the latter plane coincide, the shanks being connected with the shanks of adjoining coupling elements of the row formed by each synthetic-resin monofilament by a respective bight or bight portion.

Each coupling element can thus have a relatively long shank which lies orthogonal to the warp or the longitudinal textile threads and extends over a substantial portion of the width of the tape, this long shank terminating in a distal bight which connects it to a long shank of the next coupling element.

Each coupling element also has a short shank which can be inclined to the common axis of the eyes of each row and which terminates in a proximal bight connecting it to the short shank of an adjacent coupling element.

An important feature of the invention is that one shank running to a coupling head of the present invention is extended transverse to the warp of the tape-like unit into which the coupling coil is woven so as to receive between each coupling head and the respective bight a plurality of warp threads which pass either over or under this shank. Both shanks of each coupling element lie in mutually and directly abutting relationship in pairs so that neither the warp threads, with which the paired shanks are interwoven, nor any additional weft threads which may be applied, nor any stitching threads pass between the shanks of each pair.

According to another essential feature of the invention, alluded to previously, each coupling element is formed as a loop or eye segment in the region in which it acts as a coupling head and interdigitates with the coupling heads of the opposite coil with the shanks to their junctions with this loop lying in a plane perpendicular to the axis of the coil and to the plane of the slide fastener so that the shanks in these junction regions have coinciding projections upon the slide fastener plane, i.e. cover one another in such projection.

However, directly following these transition or junction regions and running perpendicularly to the warp away from each coupling head, loop or eye, the shanks of each pair are caused to lie in mutually abutting relationship against one another.

Thus each pair of shanks, lying in such mutually abutting relationship, acts as a double-filament weft interwoven with the warp threads over the width of the tape-like unit along which the coil extends. Of course, where the length of one of the shanks is substantially equal to the width of the tape, no additional weft is required and this shank and the paired shanks function as the sole weft for the tapes. On the other hand, in this case and where the tape-like unit is formed integrally with an edge of the tape, extending over a span of a multiplicity of warp threads, an additional weft can be provided for the balance of the tape, the additional weft being looped about the bights of the short shanks of the coil or row.

I have used the term "coil" herein in its most general sense and it will be apparent that the same principle applies to true helices, in which the coupling elements are formed in rows by continuous turns, or to meanders. The warp threads pass over and under the paired abutting shanks to form therewith a particularly firm support structure. However, the shanks can form the weft also of a weft-inlay warp-knit fabric, each pair of shanks lying in a respective course of the knit.

More specifically these objects are attained according to my present invention in a slide fastener in which a pair of continuous flexible filaments are formed in a multiplicity of coupling elements interconnectable along confronting edges by movement of a slider thereon; each coupling element having a loop end with a coupling head, a long shank and a short shank extending from opposite sides of the loop end, and respective first and second bight portions connecting the long shank with one adjacent coupling element and the short shank with another adjacent element. Textile warp threads pass between adjacent elements, with the warp threads and the coupling elements being woven in an integral tape-like unit.

Such a slide fastener, having coupling elements generally transverse to the long shanks in spaced parallel relationship over the greater portion of their length and in vertically-superposed relationship with the short shanks for a lesser portion of its length, is self-bracing and therefore more stable in the face of external forces than those known in the art. Strength can even be increased by adding bosses on the bight portions and on the shanks.

A slide fastener assembled from such tape-like units is not only simpler to produce and stronger in operation, but also presents a lower profile than the present helix-shaped coupling elements.

According to another feature of the invention, the slide fastener is provided with textile weft threads over all or part of the width of the tape-like unit, permitting a true textile tape to extend beyond the bights of the coupling elements. The weft threads can also brace the coupling elements by wrapping around the shanks or bight portions of the element in overloops. The presence or absence of weft threads allows the ratio of overall length to diameter for the long shank to vary between substantially 5:1 and 20:1, the shorter length applying to those with significant weft arrangements having a preferred value of 8:1, the longer to those wherein the coupling elements replace the weft and extend to define the lateral boundaries of the tape-like units, having a preferred value of 13:1.

The ratio of the lengths of the long and short shanks varies between substantially 1.5:1 and 5:1, with those values between 1.5:1 and 3:1 being most suitable for having overloops of the weft pass through the second (proximal) bight portion and then around the adjacent portion of the long shank. The ratio of the diameters of the short and long shanks, irrespective of their associated bosses, can vary between 1:2 and 2:1, with the preferred arrangement, however, being when they are about equal.

It is also possible to describe the improved structure of the present invention in a somewhat different manner.

For example, if each coupling head or eye is considered to be formed by a pair of eye-forming synthetic-resin monofilament segments, one of these segments can be extended into a relatively long connecting shank while the other segment can be considered to be bridged immediately to the corresponding segment of the next coupling head by a reversely bent connecting or bridge portion. The extended axes of these second eye-forming segments intersect the slide-fastener plane. In this definition of the invention, the long or first shanks can be received in respective transverse pockets formed by the longitudinal threads, with the distal bights extending out of one pocket and into the next pocket receiving another relatively long shank of the next coupling element.

In a preferred construction of the system of the invention the so-called first eye-forming monofilament segments which are extended into the long shanks have a projection upon the slide-fastener plane forming a straight line with the projection of these long shanks, this straight line lying orthogonally to the longitudinal threads.

The projections of the second eye-forming segments of a pair of adjoining coupling elements have axes which in projection upon the slide-fastener plane form a Y.

In the slide fastener of the present invention, the bridging or proximal bight and the parts of the eye-forming synthetic-resin segments connected therewith can also be received in pockets formed by the longitudinal threads. It is, however, also possible to arrange the coupling elements such that the proximal bights are bent around one of the longitudinal threads of the warp or lie wholly outwardly of the group of longitudinal or warp threads.

The "coil" of the present invention need not be single-handed and this term is used herein to include embodiments in which the successive coupling elements of each row are alternately right and left-handed whereby the long shanks and the short shanks lie in respective planes.

In another embodiment of the invention, the eye-forming segment of each coupling head which is connected to one of the long shanks forms together therewith, in a projection on the slide-fastener plane, an arc against which the other monofilament eye-forming segment of the coupling head is pressed while the remaining length of the latter segment, connected to the bridge or proximal bight, forms a projection upon the slide-fastener plane constituting a V with the corresponding segment of the next coupling element.

In all of the cases described, the longitudinal threads cross over from top to bottom in the tape-like structure between successive long shanks and in general it is desirable to provide a textile weft thread which is interwoven with additional warp or longitudinal threads and is looped around the bridge or proximal bight. It is also possible to loop at least one textile weft around the distal bights connecting the long shanks if desired.

The slide fastener of the present invention can be a so-called "strip" fastener in which the usual support tape is not used so that the "strip," formed with the long shanks as weft and warp threads extending the full length of the strip, can be stitched by conventional sewing techniques to a garment directly, or in which the coupling elements can be inserted into a garment. Alternatively, the slide fastener can be of the conventional tape type. In the first case, the distal bights lie along one edge of the tape-like support structure or strip and can form guide plates for the slider which can extend over the full width of the strip and another strip which can be joined to the first by movement of the slider along the coils to interconnect the coupling elements. In the second case, the tape can be stitched to the garment or to the support.

An advantage of the present system resides in the fact that the spacing of the coupling elements from one another is not affected by the characteristics of the anchoring structure. The entire coupling element strip is dimensionally determinate and stable in part because the shanks which connect the coupling elements directly abut one another and because the shanks can be held in pairs by the warp without intervening of textile filament or threads between the shanks of the pairs. The paired shanks lie in pockets within the warp and are not susceptible to distortion which otherwise might affect the filaments. Changes in thickness of the warp have no effect on the pockets and even longitudinal stresses which could result in stretching of the warp do not change the relative positions of the pockets.

Furthermore, the formation of the shank pairs and their incorporation in respective pockets of the warp makes production of the slide fastener substantially simpler, especially when it is carried out on a mechanical weaving loom or knitting machine since the coupling coil can be formed by needles which are the same as those used for the inlaying of double weft with the addition of a loop-forming mandrel to produce the coupling elements, eyes or heads. Thus the present invention also involves a special weaving process and an associated apparatus.

According to this aspect of the invention, two synthetic-resin monofilament threads are woven in the warp shed as weft threads by needles which pass into the warp shed from opposite sides thereof and lie as respective filaments around a common mandrel before leaving the shed. The warp is reshedded and the weft forming by inlayed monofilament is beaten up by the batten or reed so that the two weft passes through part of each warp pocket of the filament lie in mutually abutting relationship as a double weft.

The synthetic-resin monofilament can then be subjected to thermofixing, preferably at the mandrel.

As is known in connection with the fabrication of slide fasteners with synthetic-resin monofilaments, thermofixing is a heat treatment in which the applied shape of the coupling elements and coil is stabilized, i.e. any resilient stress is relaxed.

The method can be carried out in a conventional tape-forming loom with the addition of the weft inlaying needles and a centrally disposed mandrel about which the coupling heads are formed. The mandrel may be carried by a raisable and lowerable mandrel holder operated in the cadence of operation of the weft needles to accommodate the inward and outward passes thereof.

The bridges (proximal bights) between the eye-forming segments of adjacent heads lie immediately behind the latter to limit longitudinal distortion.

BRIEF DESCRIPTION OF THE DRAWING

The above and other features will now be described in detail with reference to the accompanying drawing in which:

FIG. 15 is a diagrammatic side view of the apparatus of which FIG. 14 is a part.

SPECIFIC DESCRIPTION

Figure 2:
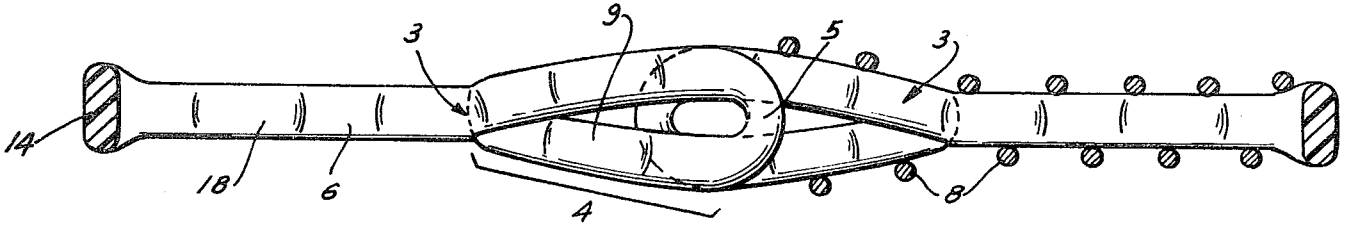
FIG. 2 is a cross-sectional view of the device of FIG. 1 taken along line II—II.
Figure 1:
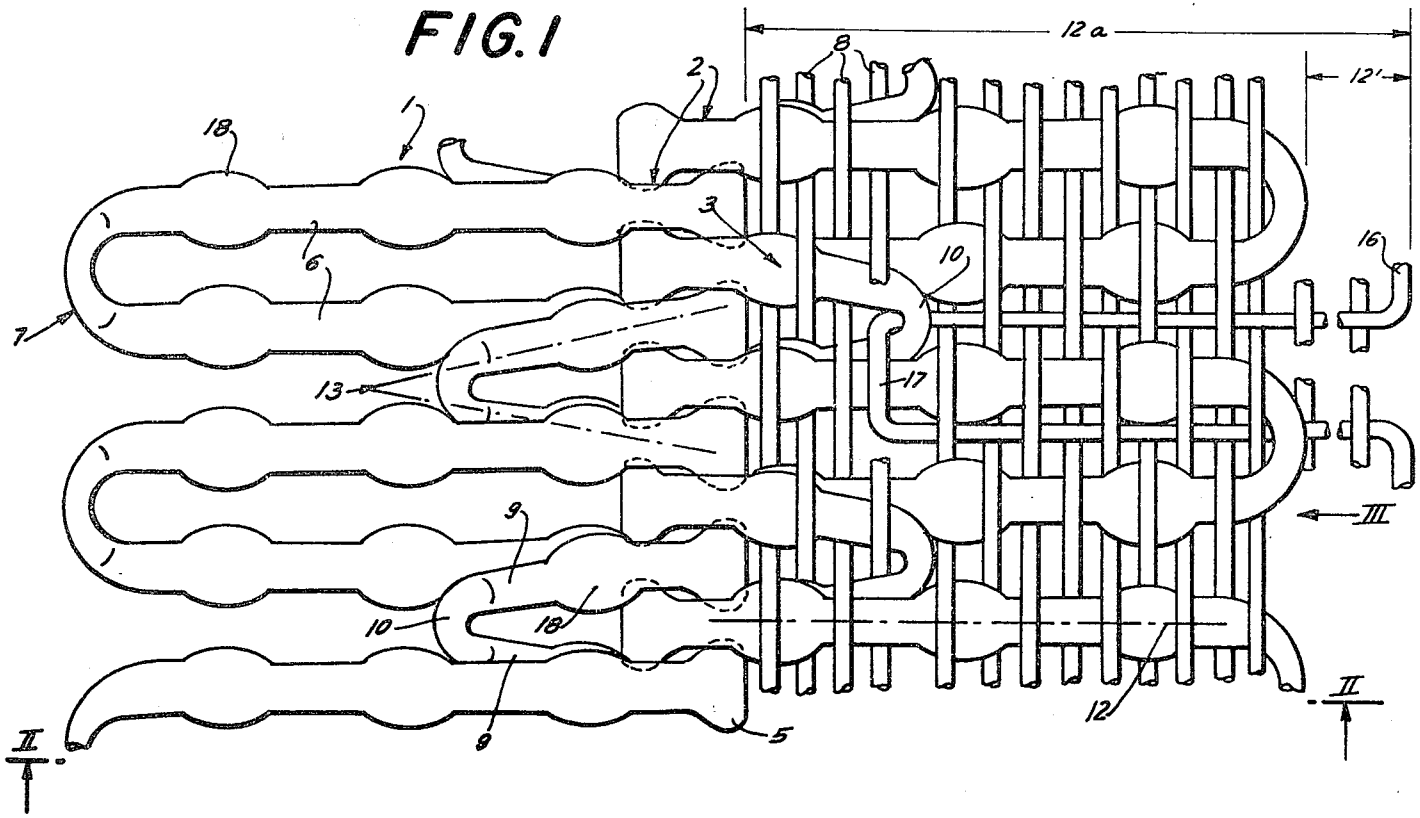
FIG. 1 is a diagrammatic plan view of a slide fastener according to my present invention.
Figure 3:
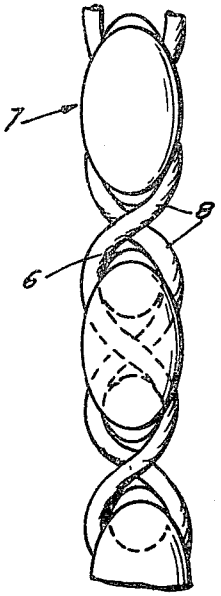
FIG. 3 is a side view of the device of FIG. 1 taken in the direction of arrow III.

As seen in FIGS. 1, 2 and 3, a slide fastener 1 has a multiplicity of coupling elements 3 comprising a coupling head 5 and locking necks 2 on a loop end 4, a long shank 6 and a short shank 9, with a first bight portion 7 connecting the long shank 6 with an adjacent long shank 6 and a second bight portion 10 connecting the short shank 9 with an adjacent short shank 9. Whereas the long shanks 6 are generally parallel to one another, the short shanks 9 diverge along a generally V-shaped path 13. Shanks 6 and 9 are provided with bosses 18 (flattenings parallel to the slide-fastener plane) and the first bight portions 7 have edge bosses 14. A multiplicity of parallel warp threads 8, running transverse to the long shanks 6, pass alternately over and under the coupling elements 3. A weft thread 16 interweaves with the warp threads 8 and bends around the coupling elements 3 in overloops 17 to form a tape-like unit 12*a* having a tape portion 12' extending beyond the first bights 7.

Figure 5:
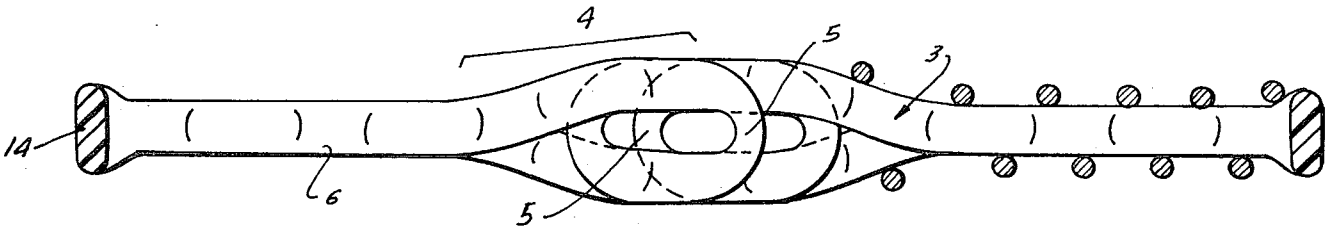
FIG. 5 is a cross-sectional view of the device of FIG. 4 taken along line V—V.
Figure 4:
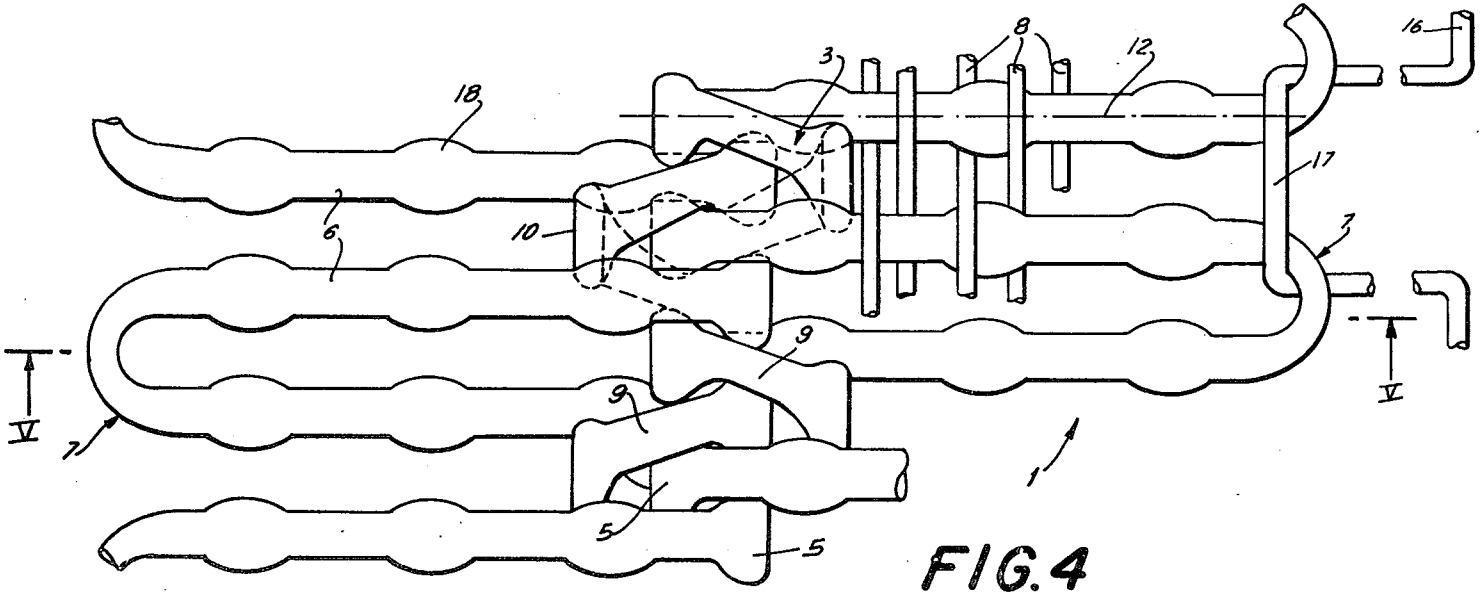
FIG. 4 is a diagrammatic plan view of another embodiment of my invention.

FIGS. 4 and 5 show a slide fastener 1 with coupling elements 3 having short shanks 9 forming short loops 19 shorter than the long loops 4 formed by the long shanks 6, with the second bight portions 10 having a similar profile to the edge bosses 14.

FIGS. 1 through 5 thus show a slide fastener in which each coupling row comprises a generally helical coil. This coil can be a true helix which is deformed or otherwise constituted with an elongated configuration.

The rows of coupling elements elements are composed of a synthetic-resin monofilament 1 and are formed with the coupling heads 2 whose coupling eyes 3 are constituted from eye-forming synthetic-resin monofilament segments 4, head formations 5 interfitting with the formations of the coupling elements of the other row, and connecting shanks 6.

The connecting shanks 6 (relatively long shanks) lie one after the other in a plane parallel to the slide-fastener plane. They are interconnected by bights 7 and are locked in the tape-like unit by textile longitudinal threads (warp threads) 8. The coupling eyes 3 project laterally from the groups of weft threads 8.

In the embodiment of FIGS. 1 and 4, the slide-fastener plane coincides with the plane of the drawing.

A comparison of the embodiment of FIGS. 1 through 3 with that of FIGS. 4 and 5 shows that one of the eye-forming synthetic-resin monofilament segments 4 of a coupling element is elongated to form the relatively long shank 6 while the other segment 4 is, immediately in the region of the eye 3, connected to the corresponding segment of an adjacent eye by a proximal bight or bridge portion 10. The bridge portions 10 are disposed immediately adjacent the coupling heads while the distal bights 7 are remote therefrom.

The extensions 9 of the proximal bights 10 intersect the slide-fastener plane.

According to the invention, the connecting shanks 6 of the successive coupling elements lie in respective pockets 11 of the warp threads, the distal bights 7 extending from one of these pockets to the other.

The eye-forming segments 4 to which the long shanks 6 are connected form straight lines in a projection on the slide-fastener plane with the long shanks 6 as represented in FIGS. 1 and 4 by the broken line 12. The segments which run to the proximal bights 10 have projections on the slide-fastener plane which form V's as represented at 13.

FIGS. 1 through 3 show clearly that the connecting portion 10 and the associated segments 4 are also received in pockets 11 of the warp threads. In this manner, this embodiment differs from that of FIGS. 4 and 5 in which the connection portions 10 and the associated segments 4 lie wholly outside the warp pockets 11. Both embodiments provide a support or tape-like structure in which the longitudinal threads 8 are constituted as warp threads of a weave in which the successive long shanks 6 extend orthogonal to the warp threads and constitute a weft. However, the longitudinal threads 8 can also represent loops of a warp knit fabric, in which case each shank 6 can lie in a respective course of the knit.

The left side of each of FIGS. 1 and 4 shows an arrangement in which the distal bights 7 can form an edge of the slide fastener (see especially my copending application Ser. No. 722,265) so that these bights 7 form ridges upon which a slider is guided. At the right-hand side of each of FIGS. 1 and 4, the coupling row and associated warp threads are to be part of a weave which is extended at 12'. The slide fastener then has the usual textile support tape 15 whereby it can be stitched to a garment or the like.

In the latter case, it is preferable to provide a textile weft thread 16 which is looped at 17 around the proximal bights 10.

It has also been found to be advantageous to subject the longitudinal threads 8 to a shrinkage treatment so that the shanks 6 are tightly bound in the pockets 11.

To improve the flexibility of the slide fastener, the shanks 6 can be provided with the aforementioned deformations 18 in the form of flattenings parallel to the slide-fastener plane to increase the bendability of the system.

Figure 7:
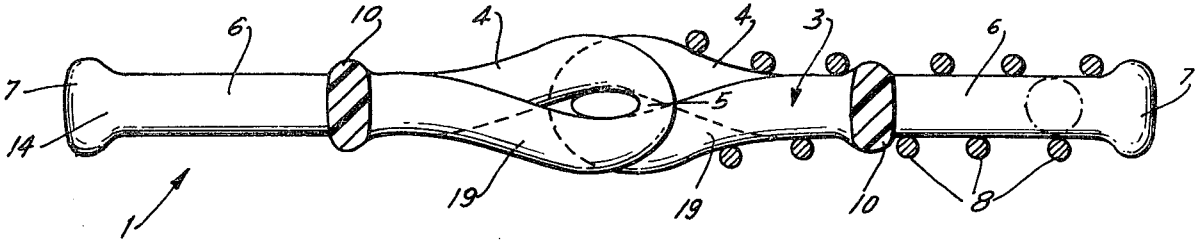
FIG. 7 is a cross-sectional view of the device of FIG. 6 taken along line VII—VII.
Figure 6:
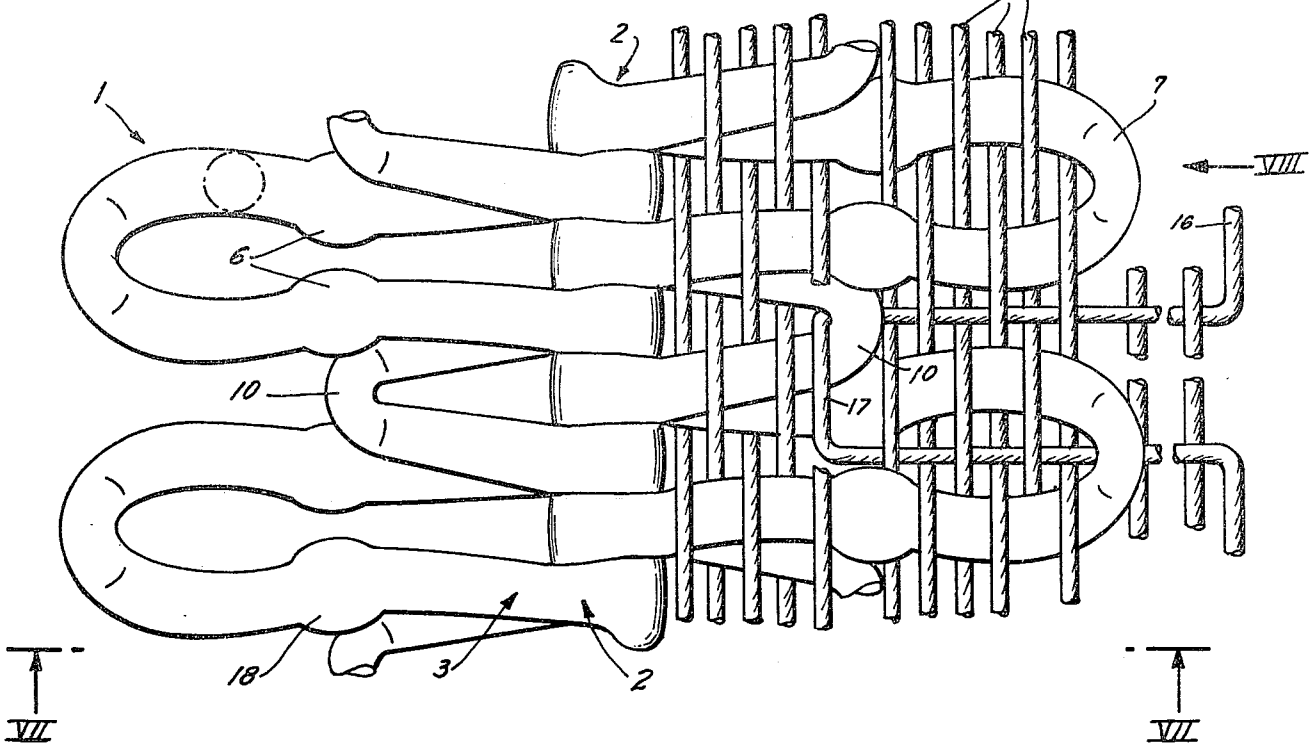
FIG. 6 is a diagrammatic plan view of another embodiment of the invention.
Figure 8:
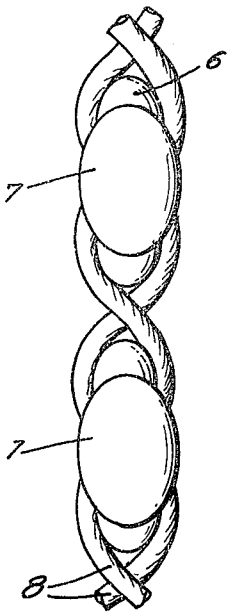
FIG. 8 is a side view of the device of FIG. 6 taken in the direction of arrow VIII.

FIGS. 6, 7 and 8 show long shanks 6 and short shanks 9 of circular cross section, with the first bight portions 7 being bow-shaped and the second bight portions 10 being V-shaped. Loop ends 4 formed by the short and long shanks 9, 6 are equal in size.

Figure 9:
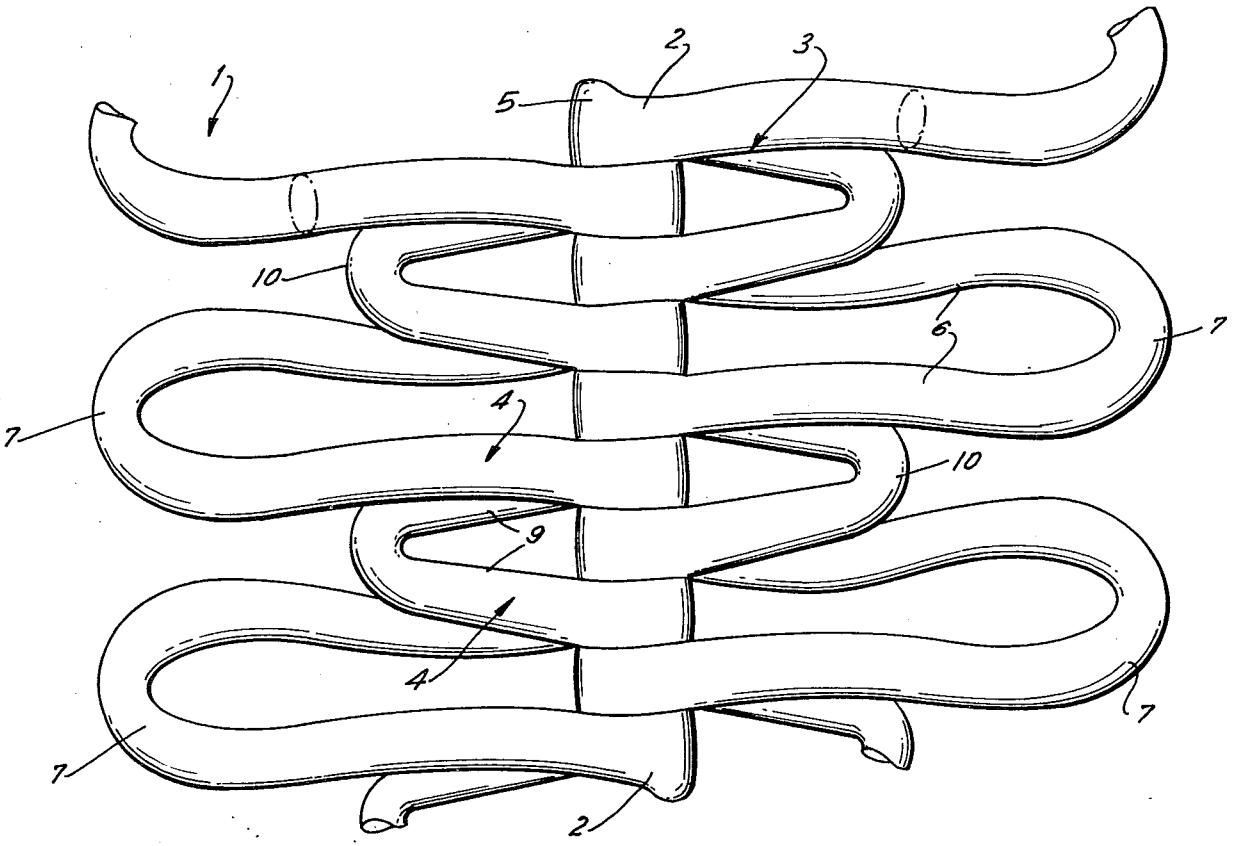
FIG. 9 is a plan view of still another embodiment of my invention.

In FIG. 9, long and short shanks 6, 9 of oval cross section are free from any projecting bosses and form loop ends 4 of equal size.

The slide fastener shown in FIGS. 6 through 9 uses the basic helical turns of the coupling rows described but form a tape-like structure 20 with the textile threads 8. Here also, the shanks 6 lie in the slide-fastener plane and are interconnected by distal bights 7. The coupling eyes 3 project beyond the longitudinal threads and the shanks 6 lie in separate longitudinal-thread pockets 11 also as previously described. In this embodiment, unlike the embodiments previously described, the long shanks 6 are not straight and have generally an S configuration over their entire lengths. The arcuate regions 19 of both sets of shanks for each coupling element may be pressed together where the two lie in a corresponding pocket of the warp threads.

Figure 10:
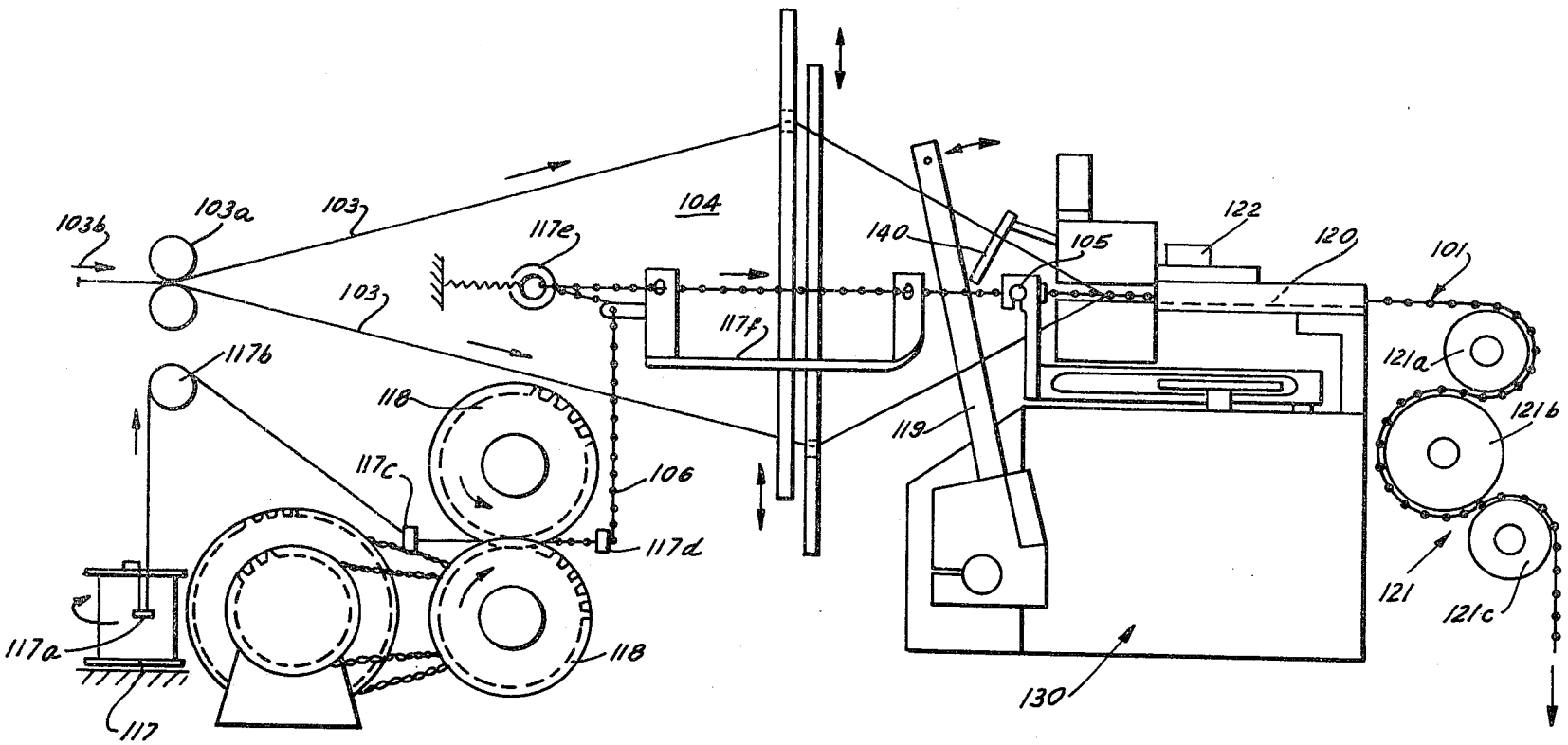
FIG. 10 is a diagrammatic side view of a slide fastener apparatus according to my present invention.
Figure 11:
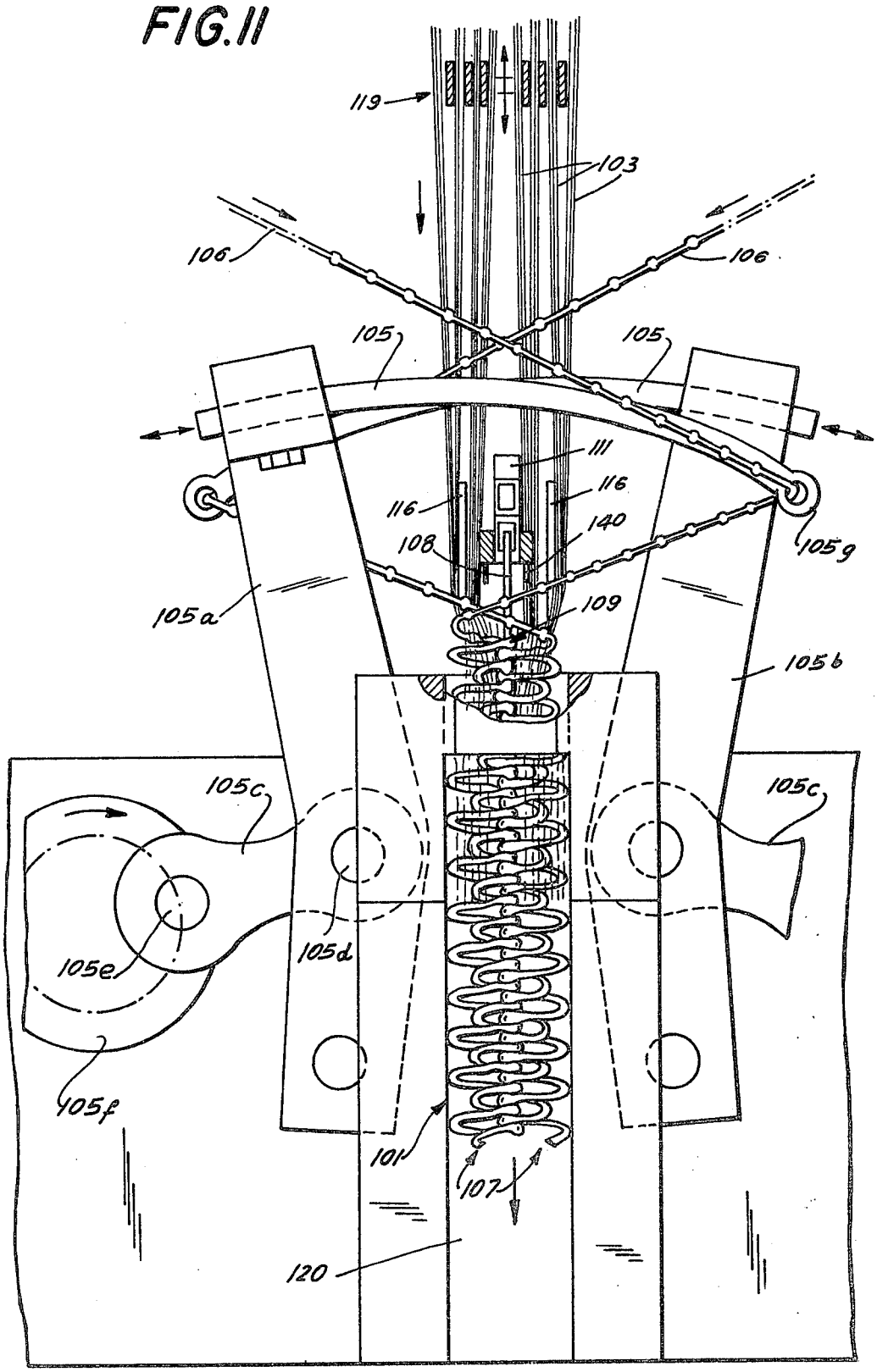
FIG. 11 is a plan view of a segment of FIG. 10 along arrow XI.

FIGS. 10 and 11 illustrate the basic elements of the apparatus for fabricating the interdigitating (tapeless) slide fastener structures shown at the left-hand side of FIGS. 1 and 4 and represented, in FIGS. 10 and 11, at 101.

The apparatus comprises a warp-feed beam (not shown) from which the warp threads 103 are passed between a pair of rollers 103*a* in the direction of arrow 103*b*, the warp threads traversing respective heddles 102*a* of a harness 102 capable of forming a warp shed 104. As will be apparent from FIG. 11, the warp threads are divided into two groups and have a space between them.

From each side of the loom, respective weft-inlaying needles 105 carry the respective synthetic-resin monofilaments 106 into and through the respective sheds. To this end, the needles 105 are carried by arms 105*a* and 105*b* driven by links 105*c* which are articulated to the arms 105*a* 105*b* at pivots 105*d*. Each link is swingable on an eccentric pin 105*e* driven by a wheel 105*f* so that the needles are swung alternately to the right and to the left through respective sheds. The needles are synchronized with the heddle control (not shown) which can be of the usual tape-weaving type, and with the batten or reed 119 which is swingable, as can be seen in FIG. 10, to beat up the weft as it is led into the shed. Guides 116 engage the filaments to form the bights remote from the heads and prevent the weft inlaying from pulling the warp 103 inwardly.

As is also apparent from FIG. 10, at each side the monofilament 106 is drawn from a spool 117 through a traveling eye 117*a* and passes over a guide roller 117*b* and between a pair of eyes 117*c* and 117*d* between a pair of embossing rollers 118 which can be heated ultrasonically or otherwise to form the bosses 106*a* (corresponding to the bosses 18 of FIGS. 1 through 3) therein. The embossed monofilament is then passed through a spring-loaded eye 117*e* and a guide 117*f* to the eyelets 105*g* of the respective weft-inlay needle. The loom housing 130 is formed with a channel 120 through which the interlocked coupling elements are guided on to a takeoff unit 121 comprising a plurality of rollers 121*a* 121*b* and 121*c* which frictionally engage the strip and reversely bend it to facilitate variation of the strip. A thermofixing device in the form of a heater as represented at 122 above the guide 120 can be provided and, as will become apparent hereinafter, the bending mandrel 108 can also be extended into a heated portion which effects thermofixing of the heads to serve as a connecting wire until thermofixing is complete.

The flexible mandrel 108 is disposed centrally between the weft sheds 104 for the respective slide-fastener halves and, at the end 110 of the mandrel turned away from the downstream end 109 of the weft shed, is mounted in a raisable and lowerable mandrel holder 111 slidably.

As can be seen from FIG. 11, the weft-inlaying needles 105 lie in horizontal planes disposed one above the other so that their filament-entraining ends can cross over in the shed 104.

The mandrel holder 111 is received in a centrally interrupted vertical guide 112 and can be shifted by a plunger arrangement 113 between its upper and lower positions in which it is retained by magnets 114.

Figures 13, 13A, 13B:
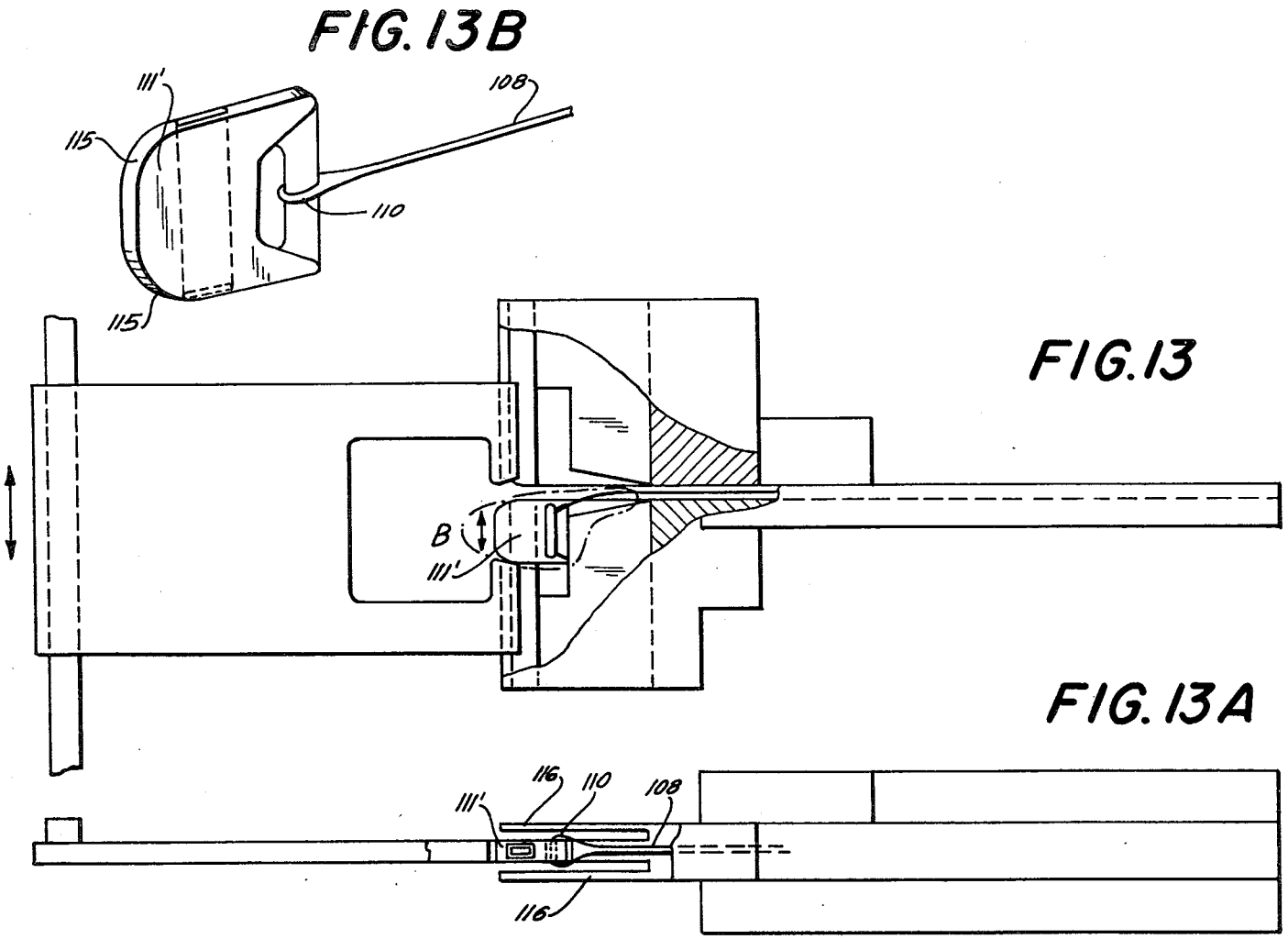
FIG. 13 is a side view, partly cut away, of another embodiment of the device of FIG. 12.
FIG. 13*a* is a plan view of the device of FIG. 13.
FIG. 13*b* is an isometric view of the area XIII*b* of FIG. 13.

Of course, this holding arrangement 114 can be eliminated and the device can be constituted, as shown in FIG. 13*b*, with rounded corners 115 of the mandrel holder 111′ so that it is cammed (FIGS. 13 and 13*a*) into its upper and lower positions.

The device illustrated in FIGS. 10 through 13 operates as follows:

Two supply spools 117 feed respective synthetic-resin monofilaments 106 through respective embossing roller pairs 118 to the respective weft needles. As can be seen from FIG. 11, the weft needles 105 lay the monofilament 106 into the warp shed across the lower set of warp threads and pass the mandrel 111. The mandrel 111 thereupon drops and the needles 105 withdraw the filament again only limitedly across the lower threads of the shed until respective fingers 140 swing in to intercept the filament and form the proximal bights 10. The harness is actuated to reverse the shed and the weft is beaten up by the reed 119. Each shed, therefore, forms a pocket for a pair of mutually contacting shanks of the coupling elements. The process is repeated with the new shed and as many times as necessary to produce the desired length of slide fastener.

The length of the mandrel 108 is so selected that the coupling heads withdraw therefrom only after a considerable number of coupling heads are interdigitated by the needles. The mandrel can remain in place within the coupling heads until thermofixing has relaxed the stresses of the monofilament. Advantageously, the warp filaments are shrinkable and are subjected to a thermal shrinking operation to reduce their length by 10 to 15% to ensure a particularly tight grip of the shanks in the warp pockets.

The system has been described for the fabrication of a substantially coiled coupling element, in which the coupling heads are generally wound around the mandrel. However, it is possible to provide the coupling elements 107 as U-shaped meander structures in which case the inlaying needles 105 are displaced following the respective weft inlays so that one monofilament is brought over the other and vice versa in successive operations.

Figure 12:
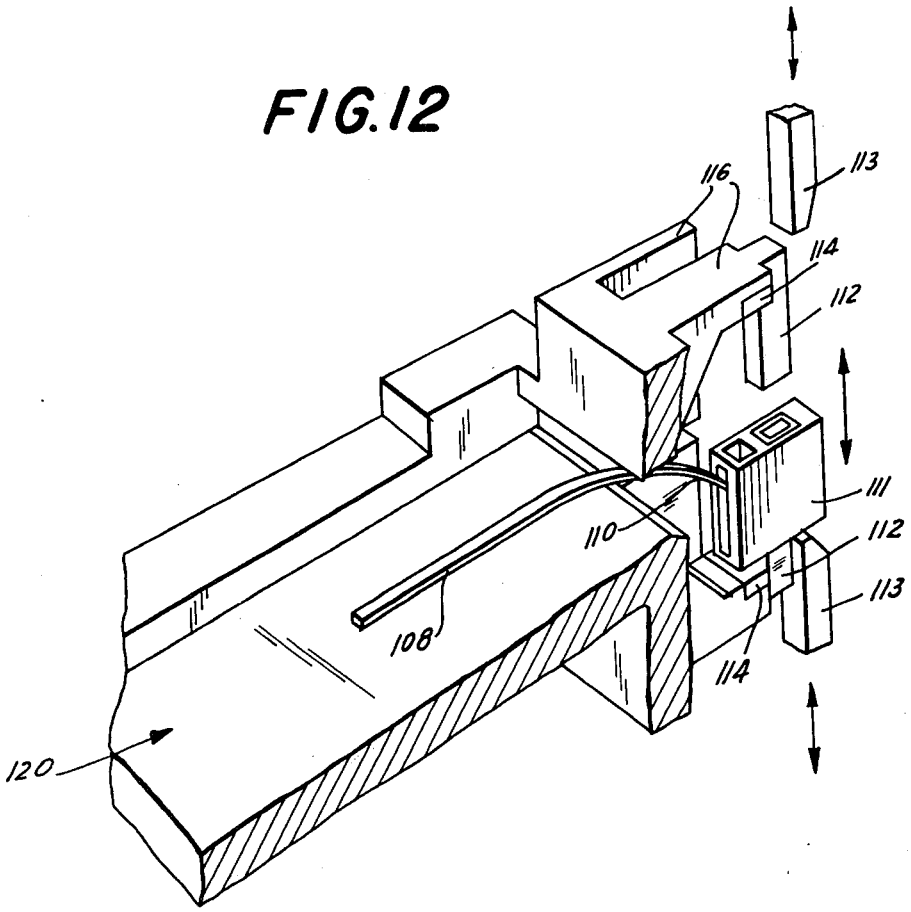
FIG. 12 is an isometric view of the apparatus of FIG. 11 partly cut away.
Figure 14:
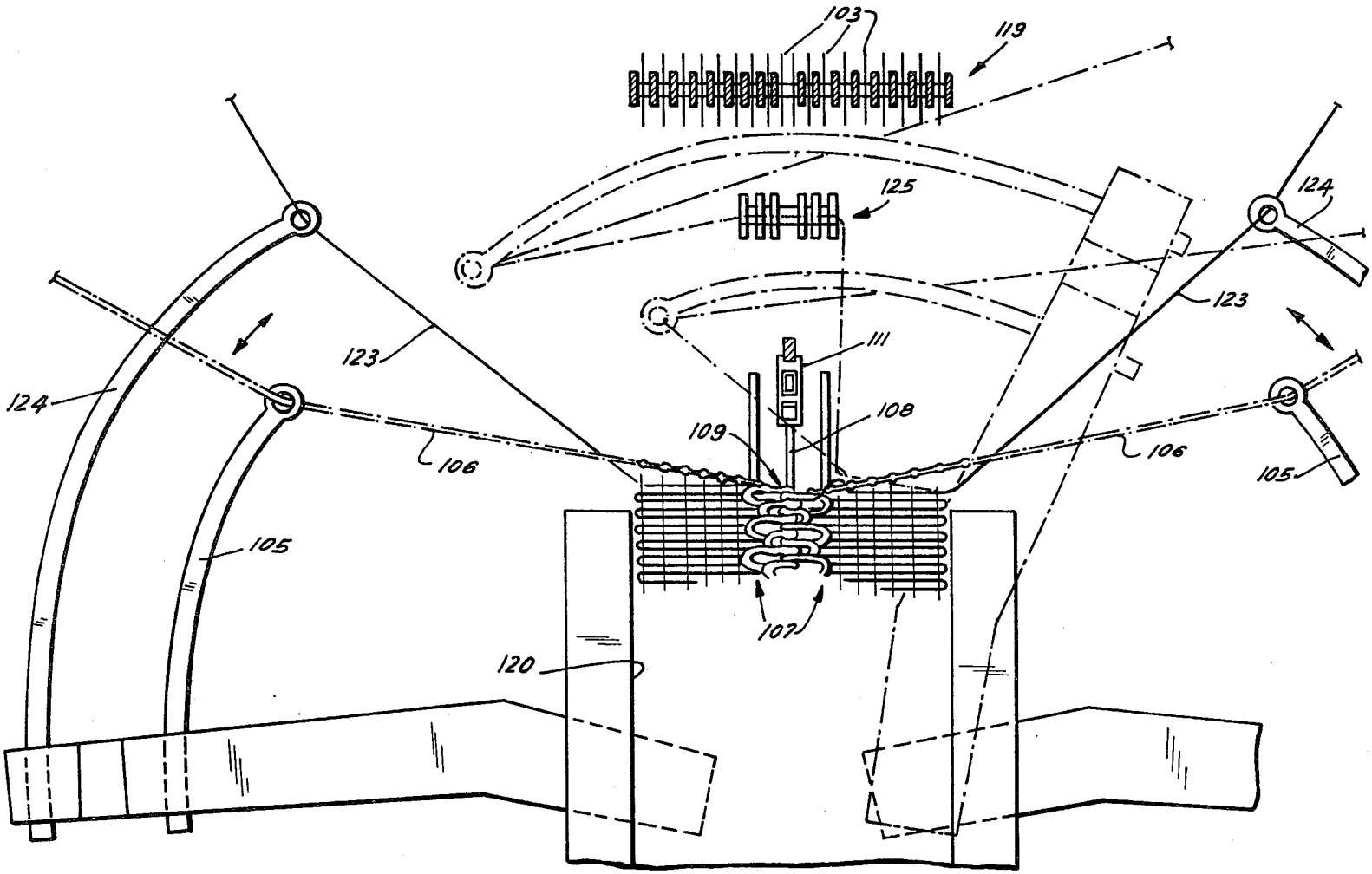
FIG. 14 is a plan view of a variation of the device of FIG. 11.
Figure 15:
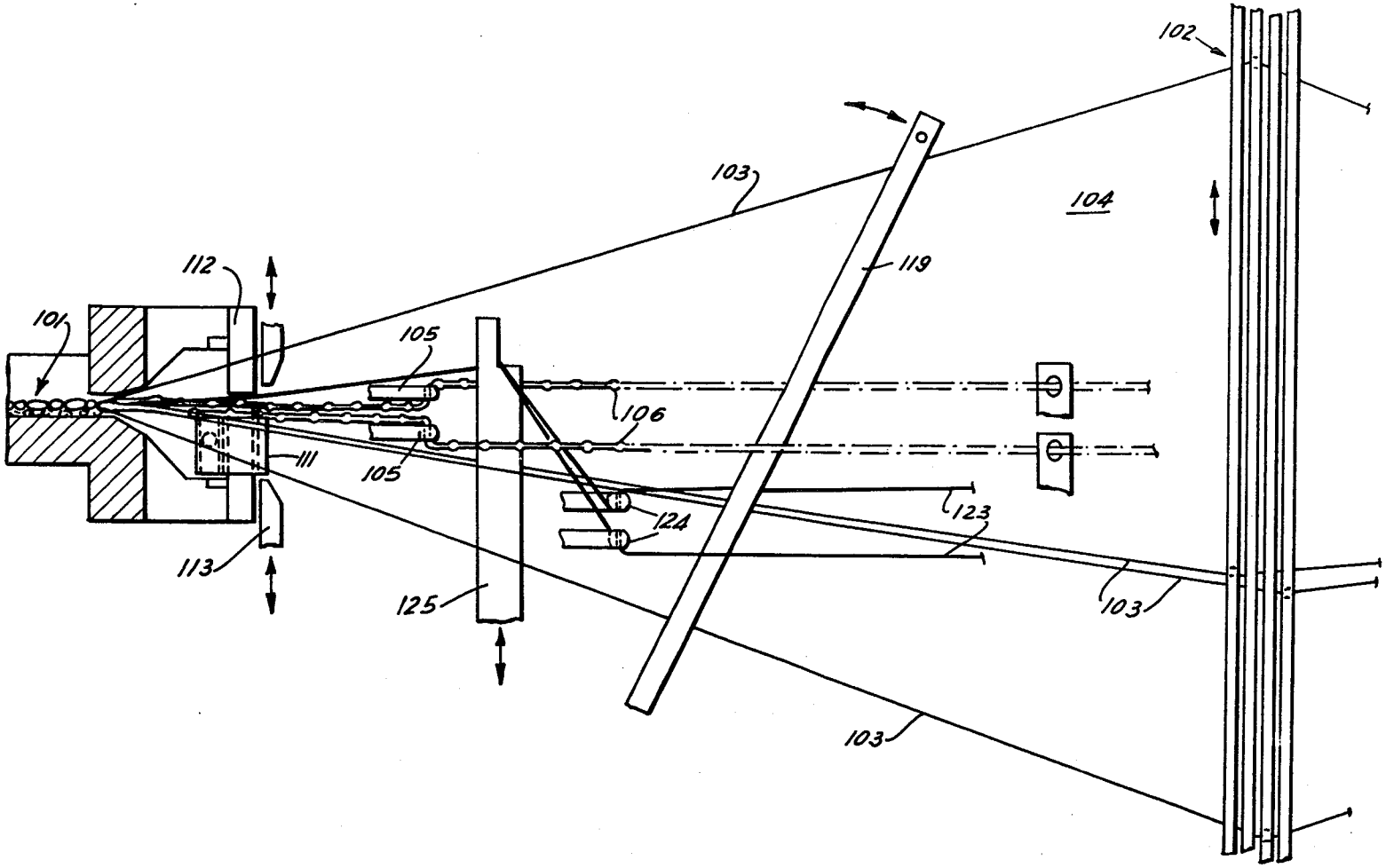

The system illustrated in FIGS. 14 and 15 differs from that of FIGS. 11 through 13 only in that the weft needle assemblies, in addition to the weft needles 105 for the monofilament, designed to coil the latter over only part of the width of the web (see the right hand sides of FIGS. 1 and 3), include needles 124 carrying additional weft threads 123 across the region 12′ of the tape to hook into the proximal bights of the filament before they reach the mandrel 108. A weft thread lifter 125 is here provided to insure proper engagement of each proximal bend of the monofilament with the textile thread weft. The fingers 140 are omitted. The remaining structure of course is the same as that of FIGS. 11–13 and a similar mode of operation prevails.

I claim:

1. A process for producing a slide-fastener stringer having a pair of interconnected stringer halves each with a respective support tape and a coupling element having a multiplicity of coupling heads along an edge of the tape, said process comprising the steps of:

(a) shedding parallel warp threads on opposite sides of a mandrel to form a pair of warp sheds at the same level simultaneously;

(b) inserting from each side of the warp into the resulting sheds with respective weft needles, respective strands of synthetic-resin monofilament adapted to form said coupling elements and looping said strands around said mandrel while withdrawing said strands at the sides from which they were inserted after crossing them over, thereby laying each strand as a double weft in each of said sheds;

(c) reshedding the warps and beating up the weft so that each coupling head is formed as a loop around said mandrel and has a pair of shanks inlaid in the respective tape as a double weft; and (d) repeating steps (a) to (c) to completely weave said stringer with the coupling heads as they are formed around said mandrel being interdigitated.

2. The process defined in claim 1, further comprising the step of inserting into said warp and each of said stringer halves a weft thread and hooking the latter weft thread around the respective strand forming the respective coupling element.

3. The process defined in claim 1 wherein said monofilament is thermoformed on said mandrel.

4. A loom for producing a slide-fastener stringer having a pair of interconnected stringer halves each with a respective support tape and a coupling element having a multiplicity of coupling heads along an edge of the tape, said loom comprising:

(a) means for advancing a warp consisting of a pair of groups of warp threads;

(b) a forming mandrel disposed between said groups of warp threads;

(c) means for raising and lowering said mandrel;

(d) harness means for shedding each of said groups of warp threads on opposite sides of said mandrel to form a pair of warp sheds at the same level;

(e) a pair of weft needles swingable into said sheds from opposite sides of the warp for inserting into said sheds respective strands of synthetic-resin monofilament adapted to form said coupling elements and looping said strands around said mandrel while withdrawing said strands at the sides of the warp from which they were inserted after crossing them over, thereby laying each strand as a double weft in each of said sheds;

(f) means for beating up the weft so that each coupling head is formed as a loop around said mandrel and has a pair of shanks inlaid in the respective tapes as a double weft, said mandrel being raised and lowered in the cadence of movement of said needles into and out of said sheds; and (g) a vertical displaceable mandrel holder and magnet means for releasably retaining said mandrel holder in upper and lower positions.

5. The loom defined in claim 4 wherein each of said needles is provided with a thread inlaying member for introducing a weft thread into at least part of the warp group and in engagement with the respective strand.

6. The loom defined in claim 4, further comprising means for heating said strands on said mandrel to thermofix said head.

* * * * *